US007354044B2

(12) United States Patent
Peiten et al.

(10) Patent No.: US 7,354,044 B2
(45) Date of Patent: Apr. 8, 2008

(54) PARTITIONED PARTICULATE BULLET TRAP

(75) Inventors: Jeffrey Peiten, La Puente, CA (US); Joe G. Tom, Vicksburg, MS (US); Charles A. Weiss, Jr., Clinton, MS (US); Philip G. Malone, Vicksburg, MS (US); Steven L. Larson, Vicksburg, MS (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 738 days.

(21) Appl. No.: 10/848,433

(22) Filed: May 19, 2004

(65) Prior Publication Data

US 2004/0212151 A1 Oct. 28, 2004

Related U.S. Application Data

(63) Continuation-in-part of application No. 10/307,427, filed on Dec. 2, 2002, now Pat. No. 6,837,496.

(51) Int. Cl.
*F41J 1/12* (2006.01)

(52) U.S. Cl. ..... 273/410

(58) Field of Classification Search ..... 273/404, 273/410; 89/36.02; 528/484; 106/672
See application file for complete search history.

(56) References Cited

U.S. PATENT DOCUMENTS 4,728,109 A * 3/1988 Simonetti ..... 273/410
4,786,059 A * 11/1988 Barini ..... 273/410
5,435,571 A 7/1995 Wojcinski et al.
5,607,163 A 3/1997 Nesler
5,848,794 A 12/1998 Wojcinski et al.
5,901,960 A 5/1999 Nesler et al.
6,000,700 A 12/1999 Nesler et al.
6,027,120 A 2/2000 Wojcinski et al.
6,173,956 B1 1/2001 O'Neal
6,264,735 B1 7/2001 Bean et al.
6,293,552 B1 9/2001 Wojcinski et al.
6,378,870 B1 4/2002 Sovine
6,446,974 B1 9/2002 Malone et al.
6,573,358 B2 6/2003 Michels et al.
6,837,496 B2 * 1/2005 Larson et al. ..... 273/410

FOREIGN PATENT DOCUMENTS

WO WO 91/17408 11/1991

* cited by examiner

*Primary Examiner*—Mark S Graham
(74) *Attorney, Agent, or Firm*—Scott A Felder; Nicholaus J. Landau; Earl H. Baugher, Jr.

(57) ABSTRACT

A backstop for decelerating and trapping projectiles includes a support structure having at least one bin shielded from incoming rounds. A trapping medium, such as a resilient granular ballistic medium and a hydrated SAP gel, is disposed contiguously on an upper surface and within the bins. Bins are defined by transverse baffles spanning the width of the backstop. The baffles are preferably constructed of a non-ricochet material. Vibrations will urgetrapped rounds downwards into the bins. In embodiments, the lower surface of one or more bins declines toward either or both sides of the backstop, such that vibration urges spent rounds towards collection points along the sides of the backstop. Access ports may be provided in the backstop sidewalls proximate these collection points to allow for removal of spent rounds. The volume removed may be filtered to reclaim projectile trapping medium for reuse.

21 Claims, 4 Drawing Sheets

PARTITIONED PARTICULATE BULLET TRAP

This Application is a continuation-in-part of application Ser. No. 10/307,427, U.S. Pat. No. 6,837,496 filed Dec. 2, 2002.

STATEMENT REGARDING FEDERALLY SPONSORED RESEARCH OR DEVELOPMENT

The invention described herein may be manufactured and used by or for the United States Government for governmental purposes without the payment of any royalties thereon.

BACKGROUND OF THE INVENTION

1. Field of the Invention

The present invention relates generally to the firing of projectiles on a range, and, more particularly, to an apparatus and method for decelerating and trapping munitions fired on a range.

2. Background Description

In order to maintain proficiency in the use of firearms, it is common to engage in target practice on a training range. Traditionally, the primary concern on a training range was the prevention of ricochets. Thus, ranges often use a large dirt berm behind the target to decelerate and trap the bullet.

More recently, however, considerable concern has been raised about the environmental impact of heavy metals (e.g., lead, tungsten, copper) contained within the bullet. Though a bullet fired into a mound of dirt is safely contained from the standpoint of no longer being a dangerous projectile, heavy metals within the bullet remain free to leach into the soil, thereby contaminating the environment. Thus, shooting ranges have begun to stress containment and removal of expended rounds in order to prevent environmental contamination.

Additionally, there is a growing desire to build shooting ranges within enclosed structures. This permits frequent use of the range regardless of weather and without excessive travel time. Obviously, however, use of a dirt berm behind the target is impractical for such indoor ranges.

Thus, current trends in bullet containment systems focus on two different types of systems. The first, often called a bullet stop and containment chamber, has a pair of plates that channel bullets toward an opening in a containment chamber. Inside the containment chamber are impact plates that slow the bullet to a stop. Unfortunately, such systems are relatively expensive and difficult to manufacture and maintain.

The second type of containment system is the bullet backstop or bullet trap system. Bullet backstops typically include a back plate made of steel inclined to the line of fire. On an upper surface of the back plate, a layer of material is disposed to provide a medium for decelerating and trapping bullets. This layer is several feet thick in the direction the bullet travels. The impact material is typically a resilient granular material. As a bullet impacts the material, it will decelerate sufficiently such that, if it does impact the back plate, any ricochet will be minimal.

A number of bullet traps utilize rubber chunks or chips as the impact material. For example, U.S. Pat. No. 6,378,870 to Sovine ("the '870 Patent") teaches the use of relatively large rubber nuggets disposed along a plane inclined to the line of fire, while U.S. Pat. No. 5,848,794 to Wojcinski et al. ("the '794 Patent") discloses a similar bullet trap using relatively small rubber granules disposed along an inclined plane. To reduce scatter and sluffing of the impact material, the '794 Patent further teaches the use of a self-healing membrane covering the rubber granules.

However, trapping systems like those disclosed in the '870 Patent and the '794 Patent lack inherent fire retardant characteristics. Thus, they often suffer from heat and fire problems, especially if the chips are not treated with a fire retardant, are improperly maintained, contain steel or fiber, or if the chips are relatively small. To combat these hazards, both the '870 Patent and the '974 Patent teach treating the rubber nuggets with a fire retardant. Unfortunately, some fire retardants used in these and other prior art systems tend to wash off, such that traps maintained outdoors may lose their fire retardant characteristics during and after a rain if not properly maintained.

Additionally, though extant systems trap the bullet, they typically do nothing to stabilize them from an environmental hazard standpoint. Thus, expended rounds must periodically be recovered from the trap to prevent heavy metal leaching and associated environmental contamination.

Nor do prior art systems protect or shield spent rounds from incoming rounds. As expended rounds accumulate, the possibility of incoming rounds impacting spent rounds increases, which in turn increases fire, ricochet, and fragmentation hazards. For example, the entire volume of the bullet trap disclosed in U.S. Pat. No. 6,293,552 to Wojcinski et al. ("the '552 Patent") is exposed to incoming fire. This problem is compounded in traps used with automatic weapons, which are capable of building up a significant mass of spent bullets in a relatively short period of time, increasing the need to periodically "mine" the trap to reclaim spent rounds.

To remove accumulated rounds, many prior art systems, such as the '552 Patent and U.S. Pat. No. 6,000,700 to Nesler et al. ("the '700 Patent") teach removal via a trap door or similar access panel. Both the '552 Patent and the '700Patent utilize a flowable ballistic material, and intend for a combined volume of ballistic material and spent rounds to flow out of the trap during cleaning. Since rounds will impact the trap at a number of points, however, it is often necessary to remove a substantial volume of the ballistic material in order to ensure adequate cleaning. Furthermore, the mining process is generally burdensome and time consuming.

SUMMARY OF THE INVENTION

Accordingly, it is an object of the present invention to provide a bullet trapping system that substantially reduces the likelihood of ricochets, fragmentation, and fire.

It is another object of the present invention to provide a bullet trapping system that can accommodate many different calibers and types of bullets delivered by a variety of firearms.

A further object of the present invention is to provide a bullet trapping system that requires minimal maintenance over an extended useful life.

Still another object of the present invention is to provide a bullet trapping system that shields spent rounds from the impact of incoming rounds.

Yet another object of the present invention is to provide a bullet trapping system that provides for simplified collection and removal of spent rounds.

The present invention is a backstop for decelerating and trapping projectiles. The backstop includes a support structure having an upper surface and at least one "bin" region shielded from incoming rounds. A projectile trapping medium, preferably a mixture of a resilient granular ballistic medium and a hydrated super absorbent polymer (SAP) gel, is disposed on the upper surface and within the bins.

The bin regions are defined by one or more transverse baffles, such as angled stair-shaped segments or substantially vertical walls, spanning substantially the entire width of the backstop. Preferably, the bins are defined by one or more non-ricochet producing barriers.

Natural or induced vibrations will urge trapped rounds downwards into the bins, where they will be shielded from incoming fire. In embodiments, the lower surface of one or more bins slopes downwards toward either or both sides of the backstop, such that vibration will urge spent rounds towards collection points along the sides of the backstop. Access ports may be provided in the backstop sidewalls proximate these collection points to allow for removal of spent rounds. The volume removed may be filtered (e.g., sieved) to reclaim projectile trapping medium for reuse in the backstop.

Further advantages of the present invention will be apparent from the description below with reference to the accompanying drawings, in which like numbers indicate like elements.

DETAILED DESCRIPTION OF PREFERRED EMBODIMENTS OF THE INVENTION

Figure 1:
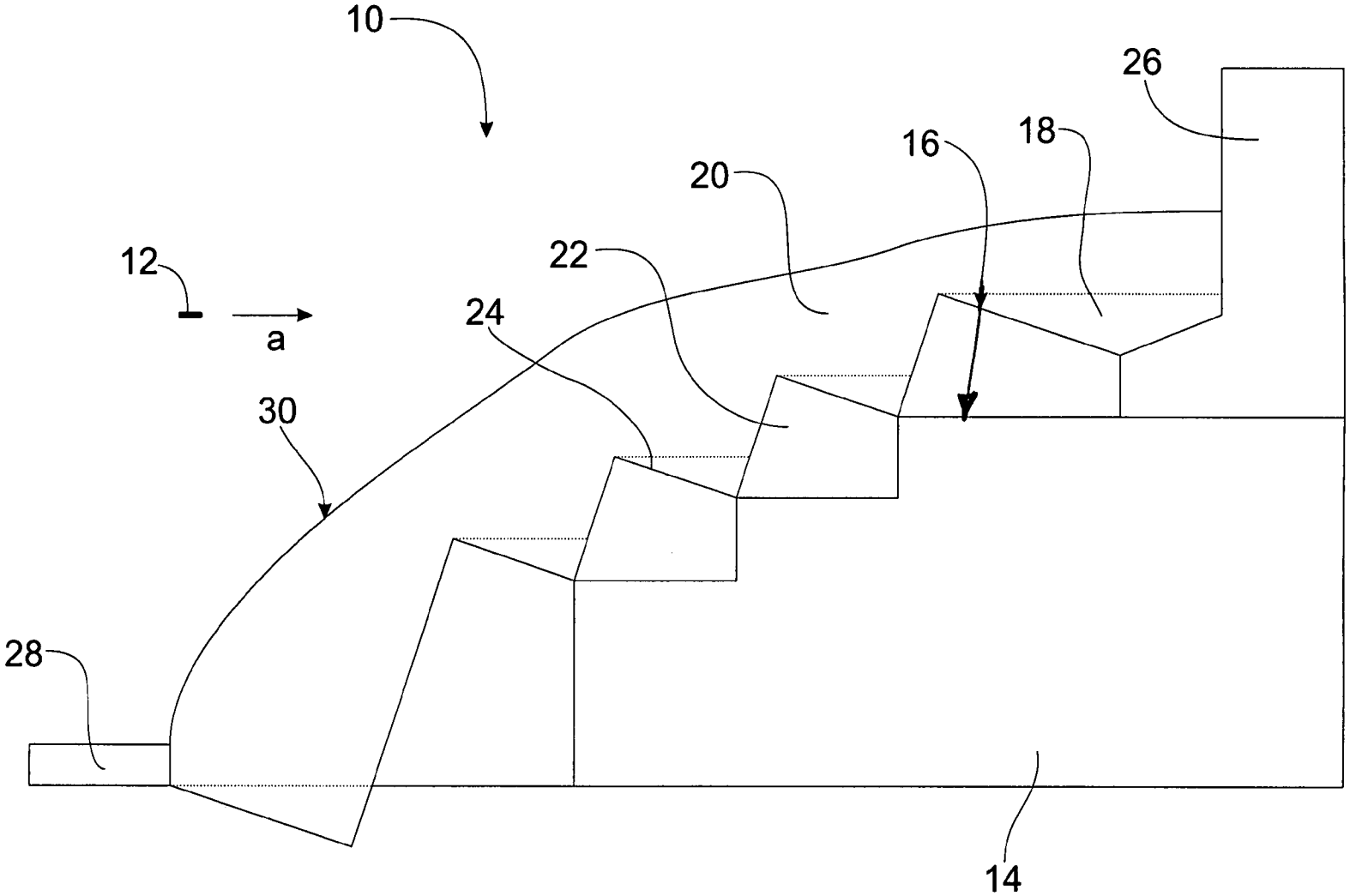
FIG. 1 is a side view of a bullet trapping backstop according to a first embodiment of the present invention.
Figure 2:
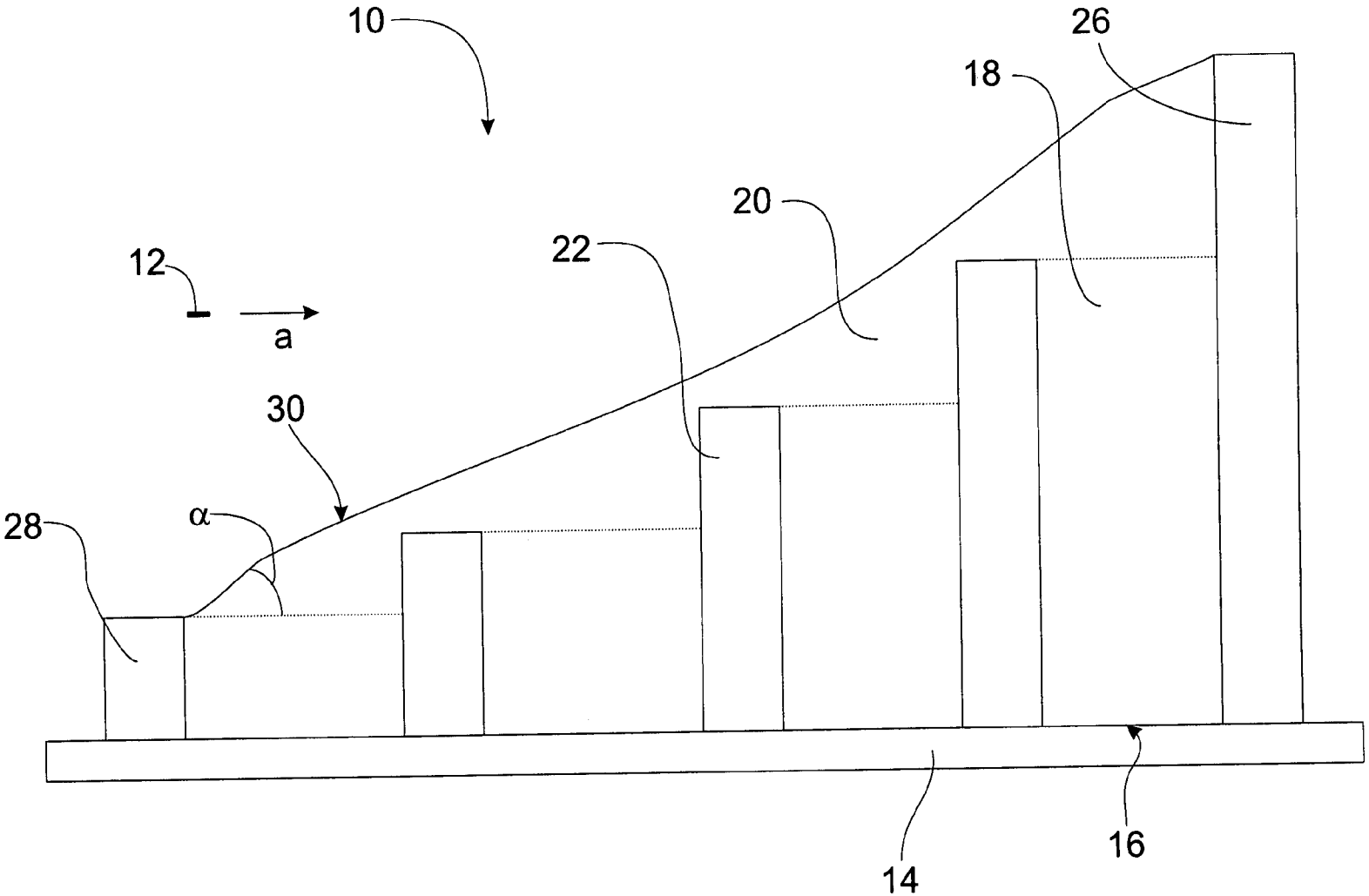
FIG. 2 is a side view of a bullet trapping backstop according to a second embodiment of the present invention.
Figure 3:
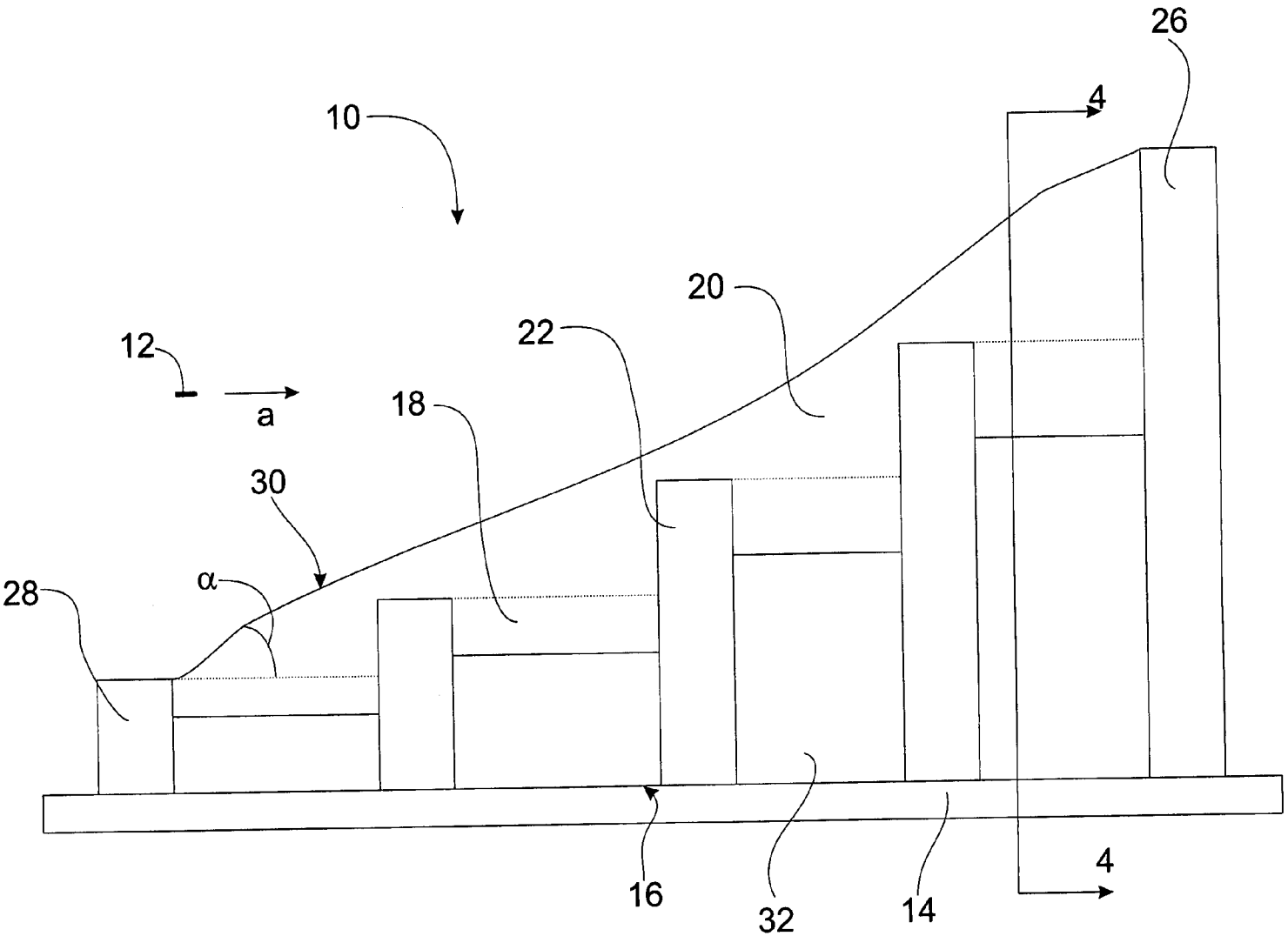
FIG. 3 is a side view of a bullet trapping backstop according to a third embodiment of the present invention.

Referring now to the drawings, and specifically to FIGS. 1-3, there is shown a bullet trapping backstop 10 for decelerating and trapping projectiles 12 traveling along a line of fire "a" towards backstop 10. (It should be understood that the terms "bullet," "projectile," and "round" are used interchangeably herein and refer to projectiles or munitions of any sort or caliber.) Backstop 10 generally includes a foundation or support structure 14 having an upper surface 16 and at least one bin 18. Bins 18 are regions shielded from the impact of projectiles 12 traveling along line of fire "a" (e.g., the regions below the dashed lines in FIGS. 1-3). One skilled in the art will understand that support structure 14 may take any number of forms (e.g., a dirt or earth berm, a concrete pad, a steel frame, a wood frame) without departing from the scope of the present invention. Preferably, support structure 14 is formed of a non-ricochet producing material. A projectile trapping medium 20 is disposed (e.g., piled) on upper surface 16 and within bins 18.

Projectile trapping medium 20 includes a resilient granular ballistic medium, such as rubber chunks, wood chips, plastic scrap, or any other material that will not produce a ricochet when impacted by a bullet. Rubber chunks are preferred because of their durability when subjected to impacts from incoming bullets. Most preferably, projectile trapping medium 20 is a mixture of a resilient granular ballistic material and a hydrated super absorbent polymer (SAP) gel to form an "artificial soil" of ballistic material "chunks" in an SAP gel matrix. That is, the ballistic material serves as a framework to hold the hydrated SAP gel, and the hydrated SAP gel occupies interstices between particles of ballistic material. This combination provides for a higher angle of repose $\alpha$, a reduced likelihood of sluffing of projectile trapping medium 20, and therefore the potential for a more compact backstop 10 in the direction of line of fire "a."

SAP will absorb up to 400 times its mass in water, such that the resulting hydrated SAP gel can be up to 97.5% water by mass, with nearly the density of water. Thus, for bullet trapping backstops 10 maintained outside, rainfall enhances, rather than impairs, performance. SAP material is marketed in a variety of forms (e.g., granules, powders, and fibers). Preferably, hydrated SAP gel is a sodium or potassium acrylate, acrylamide, or carboxylate polymer, or some combination thereof. Further, the mixture of ballistic material and SAP gel may be more than 50% SAP by volume, such that there is a substantially reduced likelihood of fire, thereby reducing or eliminating the need for flame retardant additives.

Cross-linked polyacrylate and polyamide SAP gels are most stable when maintained in a wet condition with a pH above 4.5, as they tend to shrink and shed water in acids. Additionally, higher alkalinities reduce the solubility of lead and other heavy metal ions. Thus, in embodiments, at least one additive is mixed with hydrated SAP gel to maintain a pH of at least 4.5, and preferably a pH between 8 and 12, inclusive. The most preferred additives, as discussed below, typically provide a pH of approximately 10.4.

Further, SAP gel has an inherent ability to bind lead. For example, Cetco, Inc. of Arlington Heights, Ill. claims that a granular cross-linked polyacrylate will absorb a 30 ppm lead solution, producing a volume change of 110 times the volume of the absorbent. Since most of the lead in backstop 10 will be in the form of metallic lead, however, it is also desirable to include at least one additive that will form a passive coating on the metallic particles, thereby preventing the lead from corroding, formulating soluble lead compounds, and leaching into the environment.

The preferred additives generally have low solubility in water, and will typically remain as powdery solids in the mixture. Appropriate choices are phosphates, carbonates, hydroxides, silicates, and bicarbonates, either singly or in combination. These additives can serve both purposes discussed above. That is, they will both increase the pH of the SAP gel and prevent leaching of heavy metals into the environment. They can also help stabilize the hydrated SAP gel chemically, retard the growth of mold or bacteria in the hydrated SAP gel, and enhance the flame retardant characteristics of projectile trapping medium 20. One skilled in the art will understand how to select an appropriate cation, such as potassium, sodium, aluminum, magnesium, or calcium, for the additive. It will also be apparent to one skilled in the art that different or additional additives may be used as well. However, as will be discussed below, the most preferred additives are calcium phosphate, calcium carbonate, and aluminum hydroxide.

The use of buffering and passivating additives with SAP presents additional considerations. SAP absorbs less water per unit dry weight when the water around it contains large quantities of dissolved materials. For example, a typical SAP will absorb approximately 50 times its dry weight in water in a 1% NaCl solution, but only 22 times its dry weight in a 10% NaCl solution. Most buffering and passivating compounds are most effective when they are in solution in reasonably constant concentrations. Additionally, soluble forms of phosphorus can leach out of the SAP mixture, causing environmental pollution. Furthermore, any phosphate precipitated as lead or copper phosphate is no longer available to act as a buffer.

The present invention preferably addresses these considerations by using calcium phosphate compounds having low solubilities as additives. The concentration of these calcium compounds in solution is never high enough to alter the water absorbance of the SAP. However, as the phosphate is removed by reactions with lead and copper, more solid (particulate) calcium phosphate dissolves to maintain a saturated, but not very concentrated, solution. In addition to calcium phosphate compounds, calcium carbonate and aluminum hydroxide are valuable additives. Calcium carbonate provides additional buffering capacity, while aluminum hydroxide adds to the buffering capacity and can also react with lead phosphates to form very insoluble lead aluminum phosphates.

It will be apparent to one skilled in the art how to produce an SAP mixture with a pH in the desired range and saturated with respect to the additives used. One useful method of designing projectile trapping medium 20 is to estimate the volume of ballistic material to be employed in backstop 10 and determine the proportion of interstices in that volume. Typically, this would be approximately 50% of the volume of the ballistic material. Assume that the density of the hydrated SAP gel needed to fill the interstices will approximate that of water and calculate the weight of hydrated SAP gel required. Each additive can then be added to projectile trapping medium as 5 to 10 parts of each additive for every 100 parts of hydrated SAP gel.

Bins 18 are created by constructing a series of transverse baffles 22 on upper surface 16. A non-ricochet producing material, preferably a shock absorbing, foamed, fiber-reinforced concrete such as SACON®, is used to construct baffles 22. Use of a non-ricochet material ensures that any projectiles 12 that are insufficiently decelerated by projectile trapping medium 20 will partially or totally embed themselves in baffles 22, where they will not interfere with the operation of backstop 10 or pose a hazard to personnel on the firing range. It should be apparent to one skilled in the art that other non-ricochet producing materials, such as wood, plaster board, or rubber blocks, may also be used to construct baffles 22 without departing from the scope of the invention, though foamed concrete is preferred for its safety and durability. Projectiles 12 that are fully decelerated and trapped by projectile trapping medium 20 will migrate, via gravity and natural or induced vibration, into bins 18.

Bins 18 preferably have a minimum depth, measured along line of fire "a," at least three times greater than the largest dimension of the resilient granular ballistic material used in projectile trapping medium 20. This ensures that projectile trapping medium 20 (specifically, the resilient granular ballistic material used therein) does not seal bins 18 via bridging between baffles 22. Baffles 22, and therefore bins 18, preferably extend the full width of backstop 10, though narrower baffles 22 are contemplated as within the scope of the invention. In addition to creating bins 18, baffles 22 also serve to stabilize the sloping face of projectile trapping medium 20, thereby further reducing the likelihood of sluffing and further increasing the angle of repose $\alpha$ to a value larger than about twenty-six degrees.

FIG. 1 shows a first embodiment of the backstop 10 according to the present invention. In this embodiment, baffles 22 are formed as a series of stair-shaped segments. The upper tread portions 24 of the segments are sloped downwards away from the front of backstop 10 to create bins 18. A rear separator wall 26 is also provided, and a toe block 28 may also be provided. One skilled in the art will recognize that rear separator wall 26 ensures that no projectiles 12 travel beyond backstop 10, except in cases of extreme aiming error, and that the height of toe block 28 determines the height of the front-most bin 18. Similar to baffles 22, rear separator wall 26 and toe block 28 are preferably constructed of a non-ricochet producing material.

A second embodiment of the backstop 10 is illustrated in FIG. 2. Baffles 22 are formed as one or more substantially vertical, substantially parallel walls disposed within projectile trapping medium 20. Preferably, the walls are built to a height that approaches, but does not exceed, the overall top surface 30 of projectile trapping medium 20.

Figure 4:
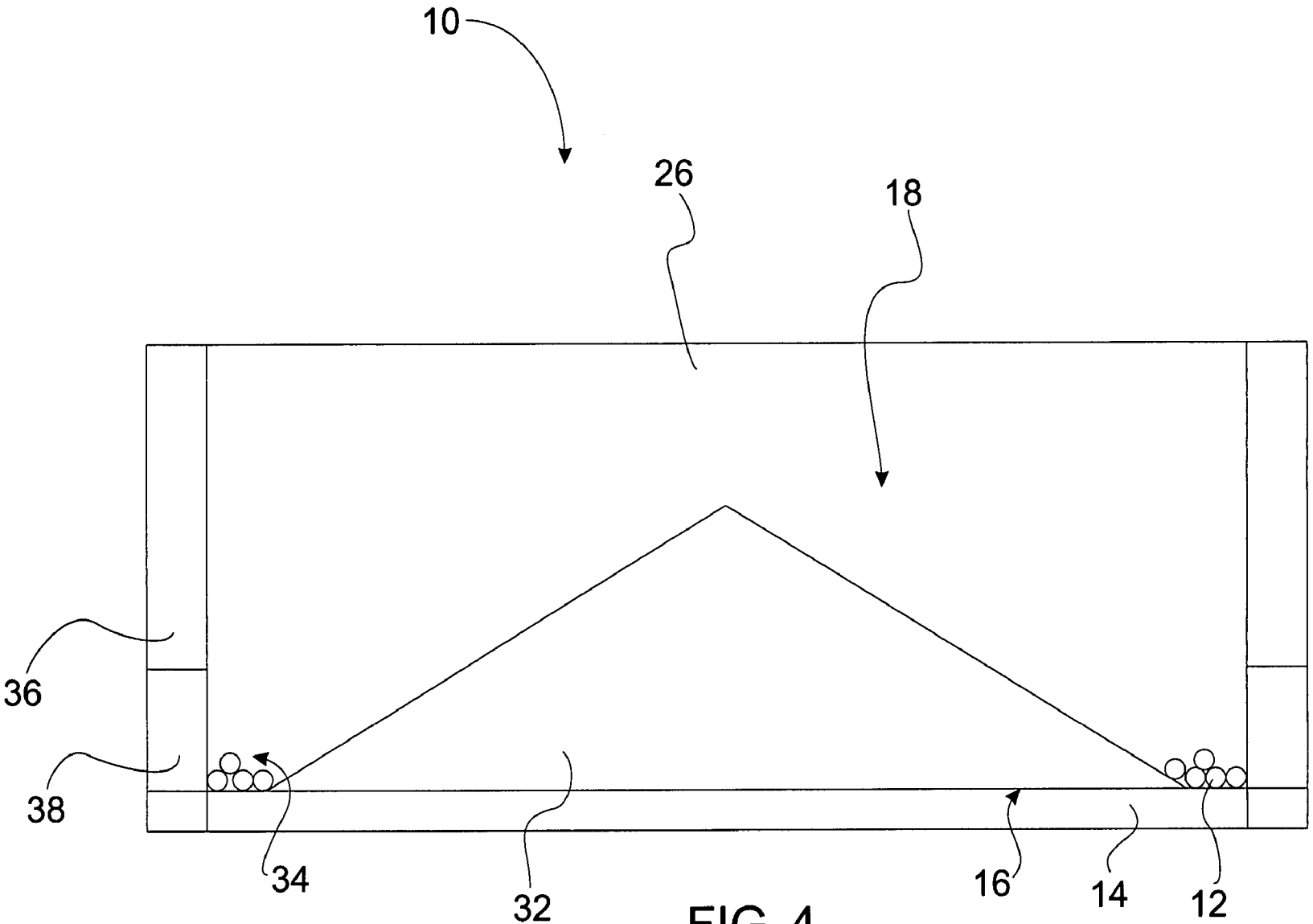
FIG. 4 is cross-sectional view of the bullet trapping backstop of FIG. 3, taken along line 4-4.

As shown in FIGS. 3 and 4, which illustrate the most preferred embodiment of the present invention, the backstop 10 of FIG. 2 can be modified to include an inclined plane base 32 in at least one bin 18. Bases 32 are inclined in at least one direction substantially perpendicular to the line of fire "a" and oriented to form at least one collection point 34 proximate at least one sidewall 36 of backstop 10 (e.g., higher nearer the centerline of backstop 10, sloping downwards towards sidewall 36). Bases 32 may be integrally formed with support structure 14, but are preferably separately constructed within bins 18 from an appropriate material. For example, a plurality of ramped blocks may be disposed within one or more bins 18 to provide inclined bases 32. One or more ports 38, corresponding to the number of collection points 34, are provided on sidewall 36 to facilitate access to collection points 34, for example as a series of ramped blocks.

As noted above, some projectiles 12 will impact backstop 10 with sufficient velocity to embed themselves in baffles 22. Other projectiles 12 will be fully decelerated by and trapped within projectile trapping medium 20. The approximately eleven-fold difference in densities between projectile trapping medium 20 and spent projectiles 12 will cause these loosely trapped spent projectiles 12 to settle naturally towards the lowest point of backstop 10. As additional projectiles 12 impact backstop 10, the resulting vibrations will further urge these spent projectiles 12 downwards into bins 18, and, in embodiments, along bases 32 towards collection points 34. If desired, vibrations may periodically be mechanically induced in backstop 10, for example with a vibrating rod or concrete (stinger-type) vibrator.

To maintain backstop 10, spent projectiles 12 are removed through ports 38, for example by using augers and scrappers. In contrast to prior art systems, spent projectiles 12 will be concentrated in the area of ports 38 rather than randomly distributed throughout projectile trapping medium 20 or concentrated in the impact area, which may not be easily accessible via a trap door or other access port. Thus, the cleaning process will remove only a minimal volume of projectile trapping medium 20. This combined volume removed may be filtered (for example, sieved) to separate spent projectiles 12 from projectile trapping medium 20, such that projectile trapping medium 20 may be returned to backstop 10.

The resulting backstop reduces the leaching of heavy metals, thus prolonging the life of the trap. Trapped rounds are environmentally stabilized (by the chemical properties of either the hydrated SAP gel or baffles 22) and isolated from incoming rounds, substantially reducing the likelihood of ricochet, fragmentation, fire, environmental, and other hazards. This also substantially reduces the need to periodically clean the trap and reclaim spent rounds, while increasing the ease of maintenance when performed. Furthermore, the backstop is adapted for use with various calibers and metals, and provides for a nearly noiseless bullet impact. The medium may also be used to quickly, simply, and securely anchor disposable papier-mache or cardboard targets, thus providing a stable and transportable target display without the use of items that will produce a ricochet or require retrieval and removal. Such targets may be located at varying heights on a single trap by mounting them on baffles 22.

While the invention has been described in terms of its preferred embodiments, those skilled in the art will recognize that the invention can be practiced with modifications within the spirit and scope of the appended claims. Thus, it is intended that all matter contained in the foregoing description or shown in the accompanying drawings shall be interpreted as illustrative rather than limiting, and the invention should be defined only in accordance with the following claims and their equivalents.

What is claimed is:

1. A backstop having a height, a width, and a depth for decelerating and trapping projectiles traveling along a line of fire, the width being defined as that dimension approximately perpendicular to the line of fire, and the depth being defined as that dimension approximately parallel to the line of fire, said backstop comprising:

a support structure having an upper surface and at least one open bin, said at least one open bin being defined at least in part by at least one transverse baffle extending substantially the entire width of said backstop; and a projectile trapping medium disposed contiguously on said upper surface and within said at least one open bin.

2. The backstop according to claim 1, wherein said at least one open bin is further defined by said upper surface of said support structure.

3. The backstop according to claim 1, wherein said at least one transverse baffle comprises at least one angled stair-shaped segment.

4. The backstop according to claim 1, wherein said at least one transverse baffle comprises at least one substantially vertical wall disposed within said projectile trapping medium.

5. The backstop according to claim 4, wherein said at least one substantially vertical wall is disposed entirely within said projectile trapping medium.

6. The backstop according to claim 4, wherein said at least one substantially vertical wall is at least two substantially vertical, substantially parallel walls.

7. The backstop according to claim 1, wherein said at least one transverse baffle comprises at least one non-ricochet producing barrier.

8. The backstop according to claim 7, wherein said at least one non-ricochet producing barrier comprises at least one shock absorbing, foamed, fiber-reinforced concrete barrier.

9. The backstop according to claim 8, wherein said shock-absorbing, foamed, fiber-reinforced concrete is SACON®.

10. The backstop according to claim 1, wherein said at least one open bin further comprises a base inclined along the width of said backstop to form at least one collection point proximate at least one sidewall of said backstop.

11. The backstop according to claim 10, further comprising at least one port on said at least one sidewall, said at least one port located to facilitate access to said at least one collection point.

12. The backstop according to claim 1, wherein said at least one open bin extends a full width of said backstop.

13. The backstop according to claim 1, wherein said projectile tapping medium comprises a resilient granular ballistic medium.

14. The backstop according to claim 13, wherein a depth of said at least one open bin is at least three times greater than a largest dimension of particles comprising said resilient granular ballistic medium.

15. The backstop according to claim 13, wherein said projectile trapping medium further comprises a hydrated super absorbent polymer (SAP) gel intimately mixed with said ballistic medium.

16. A method of forming and maintaining a backstop having a height, a width, and a depth for decelerating and trapping projectiles traveling along a line of fire the width being defined as that dimension approximately perpendicular to the line of fire, and the depth being defined as that dimension approximately parallel to the line of fire, comprising the steps of:

providing a backstop comprising a support structure having an upper surface and at least one oven bin, the at least one oven bin being defined at least in part by at least one transverse baffle extending substantially the entire width of the backstop; and disposing a projectile trapping medium contiguously on the upper surface and within the at least one open bin.

17. The method according to claim 16, further comprising the step of sloping a base of the at least one open bin along the width of the backstop to form at least one collection point proximate at least one side of the backstop.

18. The method according to claim 17, further comprising the step of removing trapped projectiles from the backstop at the at least one collection point.

19. The method according to claim 18, further comprising the step of vibrating the backstop, thereby urging trapped projectiles towards the at least one collection point.

20. The method according to claim 18, further comprising the steps of:

filtering projectile trapping media incidentally removed from the backstop during said step of removing trapped projectiles, thereby removing trapped projectiles; and returning the filtered projectile trapping media to the backstop.

21. The backstop according to claim 1, wherein said at least one open bin is fully defined by said at least one transverse baffle.

* * * * *